US006558159B2

(12) United States Patent
Bollwahn et al.

(10) Patent No.: US 6,558,159 B2
(45) Date of Patent: May 6, 2003

(54) HEAT TREATMENT CONTAINER

(75) Inventors: Lin P. Bollwahn, Lansing, MI (US); Douglas A. Jackson, Grand Ledge, MI (US); James W. Angell, East Lansing, MI (US)

(73) Assignee: Demmer Corporation, Lansing, MI (US)

( * ) Notice: Subject to any disclaimer, the term of this patent is extended or adjusted under 35 U.S.C. 154(b) by 0 days.

(21) Appl. No.: 10/155,411

(22) Filed: May 24, 2002

(65) Prior Publication Data

US 2002/0182558 A1 Dec. 5, 2002

Related U.S. Application Data

(60) Provisional application No. 60/294,121, filed on May 29, 2001, provisional application No. 60/302,728, filed on Jul. 3, 2001, and provisional application No. 60/305,664, filed on Jul. 16, 2001.

(51) Int. Cl.[7] ..... B65D 1/38

(52) U.S. Cl. ..... 432/261; 432/253; 220/4.31; 220/529; 220/532; 220/533

(58) Field of Search ..... 432/6, 9, 162, 432/261, 253; 220/4.31, 4.32, 4.28, 507, 529, 532, 533

(56) References Cited

U.S. PATENT DOCUMENTS

| | | | | | |
|---|---|---|---|---|---|
| 1,862,540 | A | | 6/1932 | Koll | |
| 2,300,783 | A | | 11/1942 | Grubel et al. | |
| 2,611,460 | A | * | 9/1952 | Nash | 403/382 |
| 4,212,690 | A | | 7/1980 | Beuykian et al. | |
| 4,463,864 | A | * | 8/1984 | Roach | 220/4.34 |
| 4,572,749 | A | | 2/1986 | Emerson | |
| 4,978,109 | A | | 12/1990 | Vigouroux | |
| 5,752,821 | A | | 5/1998 | Jo | |
| 5,960,981 | A | * | 10/1999 | Dodson et al. | 220/563 |
| 6,454,564 | B2 | * | 9/2002 | Ricchio et al. | 432/261 |

* cited by examiner

*Primary Examiner*—Gregory Wilson
(74) *Attorney, Agent, or Firm*—Mary M. Moyne; Ian C. McLeod

(57) ABSTRACT

A container (10) for holding parts during a heat treating process. The container includes a bottom plate (14), end walls (20 and 22), sidewalls (30 and 32) and dividers (40, 42 and 44) which are connected together using a tab and slot construction to form an egg crate structure. The construction of the container reduces the effects of the heat treating process on the container. The guide cradle (58) in the compartment (12) of the container supports the cylinder head in the compartment and reduces the movement of the cylinder head during the heat treating process. The positioners (60) on the top portion (58A) of the guide cradle guides the cylinder head into the guide cradle and into the compartment. The bottom portion (58B) of the guide cradle supports the cylinder head above the bottom plate.

36 Claims, 15 Drawing Sheets

HEAT TREATMENT CONTAINER

CROSS-REFERENCE TO RELATED APPLICATIONS

This application claims the benefit of U.S. Provisional Application Ser. Nos. 60/294,121 filed May 29, 2001; 60/302,728 filed Jul. 3, 2001 and 60/305,664 filed Jul. 16, 2001.

STATEMENT REGARDING FEDERALLY SPONSORED RESEARCH OR DEVELOPMENT

Not Applicable.

BACKGROUND OF THE INVENTION (1) Field of the Invention

The present invention relates to a container for holding parts during heat treating. In particular, the present invention relates to a container for holding parts during heat treating which has an egg crate construction with interlocking walls.

Heat treating is used to improve the properties, performance and durability of a part or object. In general, heat treating includes the steps of heating, quenching, normalizing, tempering and annealing the part. The main problem with the containers used in the heat treating process is that the containers warp during each heat treating session. Eventually, the extent of the warpage prevents the efficient use of the containers. In the past, containers used to hold parts during the various steps of heat treating had a very short useful life span.

(2) Description of the Related Art

The related art has shown various containers for holding parts during heat treating. Illustrative are U.S. Pat. Nos. 1,862,540 to Koll; 2,300,783 to Grubel et al; 4,212,690 to Beuyukian et al; 4,572,749 to Emerson and 4,978,109 to Vigouroux. Koll describes a heat treat carrier which has a telescoping member to permit expansion and contraction of the carrier to prevent warping and cracking of the carrier. Grubel et al describes a heat treatment rack for treating cylindrical parts. Beuyukian et al describes a heat treat fixture for mounting a specimen during heat treating to prevent warping of the specimen during treatment. Emerson describes a method and apparatus for the heat treatment of a workpiece having a cavity. Vigouroux describes a multideck heat treatment tray for the treatment of gearbox shafts. The tray is constructed as a unitary piece and is very rigid such that the tray deforms in a uniform way during heat treatment.

Also of interest is U.S. Pat. No. 5,752,821 to Jo which describes a tray for use in a heat treatment furnace.

There remains the need for a container for holding parts during heat treating which has minimal final warpage and an increased useful life span.

SUMMARY OF THE INVENTION

A container for holding parts during a heat treating process. The container has an egg crate design and is constructed using a slot and tab construction: The container includes a bottom plate, two end walls, two sidewalls and a series of first and second dividers. The bottom plate and walls form the outer shape and structure of the container. The first and second dividers extend between the sidewalls and end walls respectively, perpendicular to each other to form compartments of the container. The end walls and first dividers can be provided with lift openings which enable the container to be easily lifted without damaging the parts. The container can also be provided with guards around the outside of the walls of the container. The guards reduce damage to the walls of the container. The compartments can be provided with guide cradles which hold the parts securely in the compartments. The bottom plate, walls and dividers of the compartment are constructed of flat pieces which have less warpage than hollow tubing. Some of the pieces of the container are provided with holes to reduce the weight of the container and to allow easy access to the parts during the heat treating process. The construction and structure of the container of the present invention reduces the warpage of the container after each heat treating session.

The container of the present invention is intended to be used to hold automotive parts such as cylinder heads during a heat treating process used to harden the parts. It is understood that the compartments and guide cradles of the container could be modified such as to hold any type of parts during the heat treating process.

The present invention relates to a container for use during heat treating to hold a part, which comprises: a bottom plate having a plurality of edges; a first end wall mounted adjacent one of the edges of the bottom plate and extending outward from the bottom plate in a direction perpendicular to the bottom plate, the first end wall having a first end and a second end with opposed sides extending between the ends with at least one slot extending between the sides; a second end wall mounted adjacent one of the edges of the bottom plate opposite the first end wall and extending outward from the bottom plate perpendicular to the bottom plate in a direction similar to the direction of the first end wall, the second end wall having a first end and a second end with opposed sides extending between the ends with at least one slot extending between the sides; a first sidewall mounted adjacent one of the edges of the bottom plate and extending outward from the bottom plate perpendicular to the bottom plate in a direction similar to the direction of the first end wall, the first sidewall having a first end and a second end with opposed sides extending between the ends with at least one slot extending between the sides; a second sidewall mounted adjacent one of the edges of the bottom plate and extending outward from the bottom plate perpendicular to the bottom plate in a direction similar to the direction of the first end wall, the second sidewall having a first end and a second end with opposed sides extending between the ends with at least one slot extending between the sides; a first divider having opposed ends with a tab on each of the opposed ends and positioned such as to extend between the first and second sidewalls such that the tab at one end of the first divider extends into one of the slots of the first sidewall and the tab on the other end of the first divider extends into one of the slots of the second sidewall; and a second divider having opposed ends with a tab on each of the opposed ends and positioned such as to extend between the first and second end walls such that the tab at one end extends into one of the slots of the first end wall and the tab on the other end extends into one of the slots of the second end wall.

Further, the present invention relates to a container for use during heat treating to hold a part, which comprises: a bottom plate having opposed ends with opposed sides extending therebetween; a pair of end walls mounted on the opposed ends of the bottom plate and extending outward from the bottom plate in a direction perpendicular to the bottom plate; a pair of sidewalls mounted on the opposed sides of the bottom plate and extending outward from the bottom plate in a direction perpendicular to the bottom plate and similar to the direction of the pair of end walls; first dividers having opposed ends with a first side and a second side extending between the ends and having slots extending from the first side toward the second side and positioned such that one of the ends is adjacent one of the sidewalls and the other one of the ends is adjacent the other one of the sidewalls and extending in a direction similar to the direction of the pair of sidewalls; and second dividers having opposed ends with a first side and a second side extending between the ends and having slots extending from the second side toward the first side and positioned such that one of the ends is adjacent one of the end walls and the other one of the ends is adjacent the other one of the sidewalls and extending in a direction similar to the direction of the pair of end walls and wherein the slots of the first dividers interlock with the slots of the second dividers such that the first and second dividers are interconnected.

Still further, the present invention relates to a method for heat treating a part, which comprises: providing a heat treat container including a bottom plate having a plurality of edges; a first end wall mounted adjacent one of the edges of the bottom plate and extending outward from the bottom plate in a direction perpendicular to the bottom plate, the first end wall having a first end and a second end with opposed sides extending between the ends with at least one slot extending between the sides; a second end wall mounted adjacent one of the edges of the bottom plate opposite the first end wall and extending outward from the bottom plate perpendicular to the bottom plate in a direction similar to the direction of the first end wall, the second end wall having a first end and a second end with opposed sides extending between the ends with at least one slot extending between the sides; a first sidewall mounted adjacent one of the edges of the bottom plate and extending outward from the bottom plate perpendicular to the bottom plate in a direction similar to the direction of the first end wall, the first sidewall having a first end and a second end with opposed sides extending between the ends with at least one slot extending between the sides; a second sidewall mounted adjacent one of the edges of the bottom plate and extending outward from the bottom plate perpendicular to the bottom plate in a direction similar to the direction of the first end wall, the second sidewall having a first end and a second end with opposed sides extending between the ends with at least one slot extending between the sides; a first divider having opposed ends with a tab on each of the opposed ends and positioned such as to extend between the first and second sidewalls such that the tab at one end of the first divider extends into one of the slots of the first sidewall and the tab on the other end of the first divider extends into one of the slots of the second sidewall; and a second divider having opposed ends with a tab on each of the opposed ends and positioned such as to extend between the first and second end walls such that the tab at one end extends into one of the slots of the first end wall and the tab on the other end extends into one of the slots of the second end wall; positioning the part in the container; heating the container with the part; and quenching the container with the part.

The substance and advantages of the present invention will become increasingly apparent by reference to the following drawings and the description.

DESCRIPTION OF THE PREFERRED EMBODIMENTS

Figure 1:
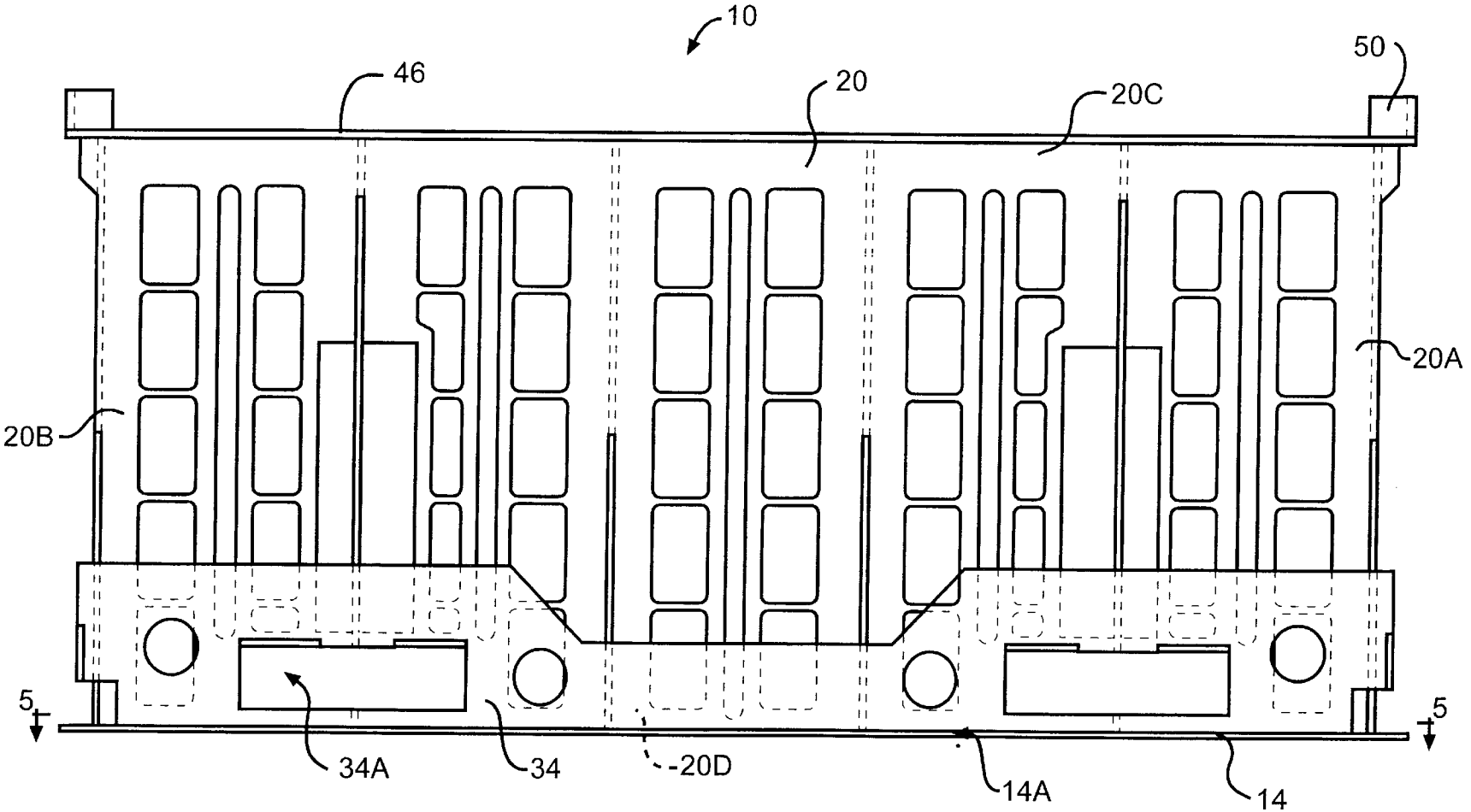
FIG. 1 is a front view of the container 10 of the present invention.
Figure 2:
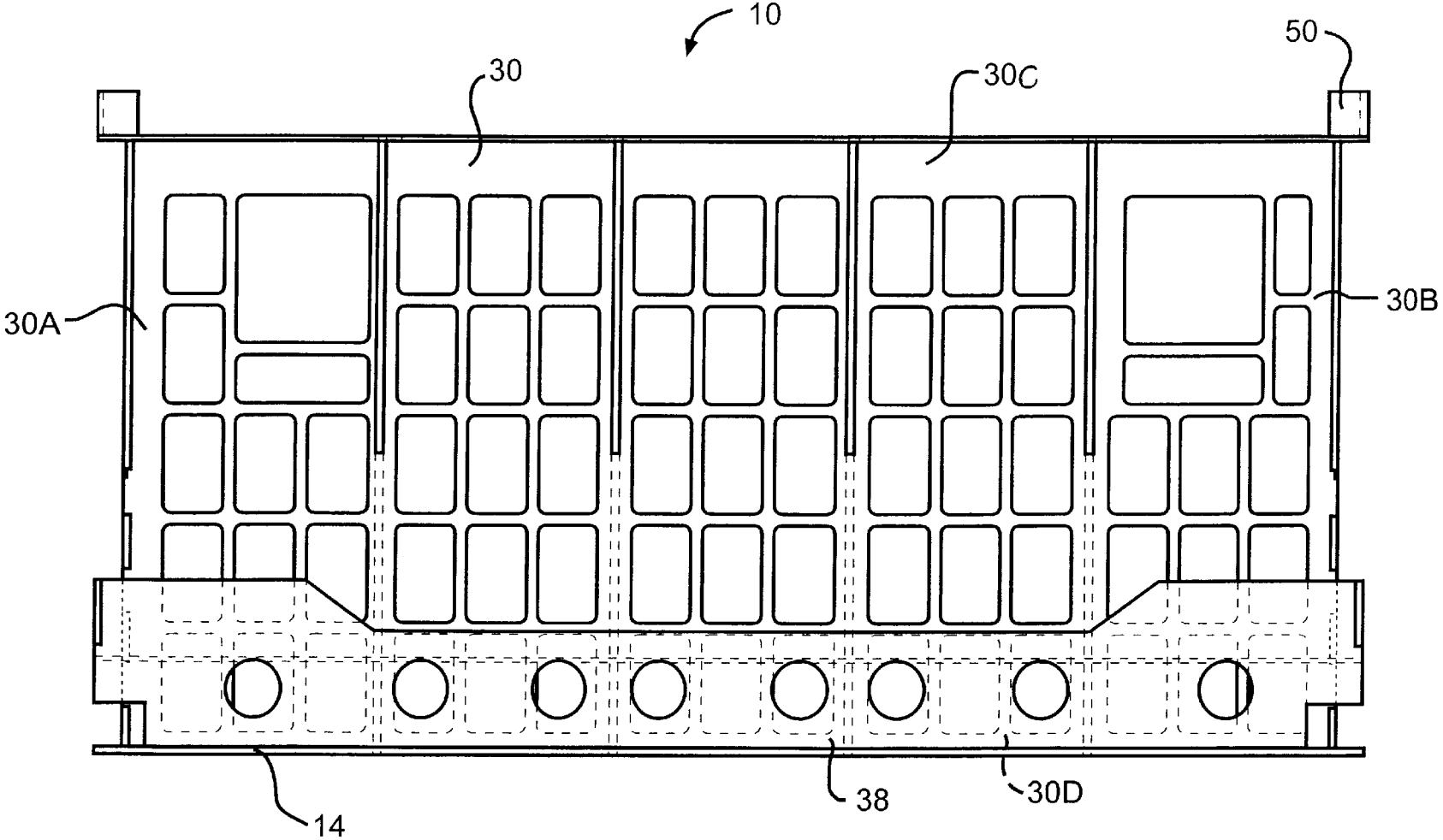
FIG. 2 is a side view of the container 10.
Figure 3:
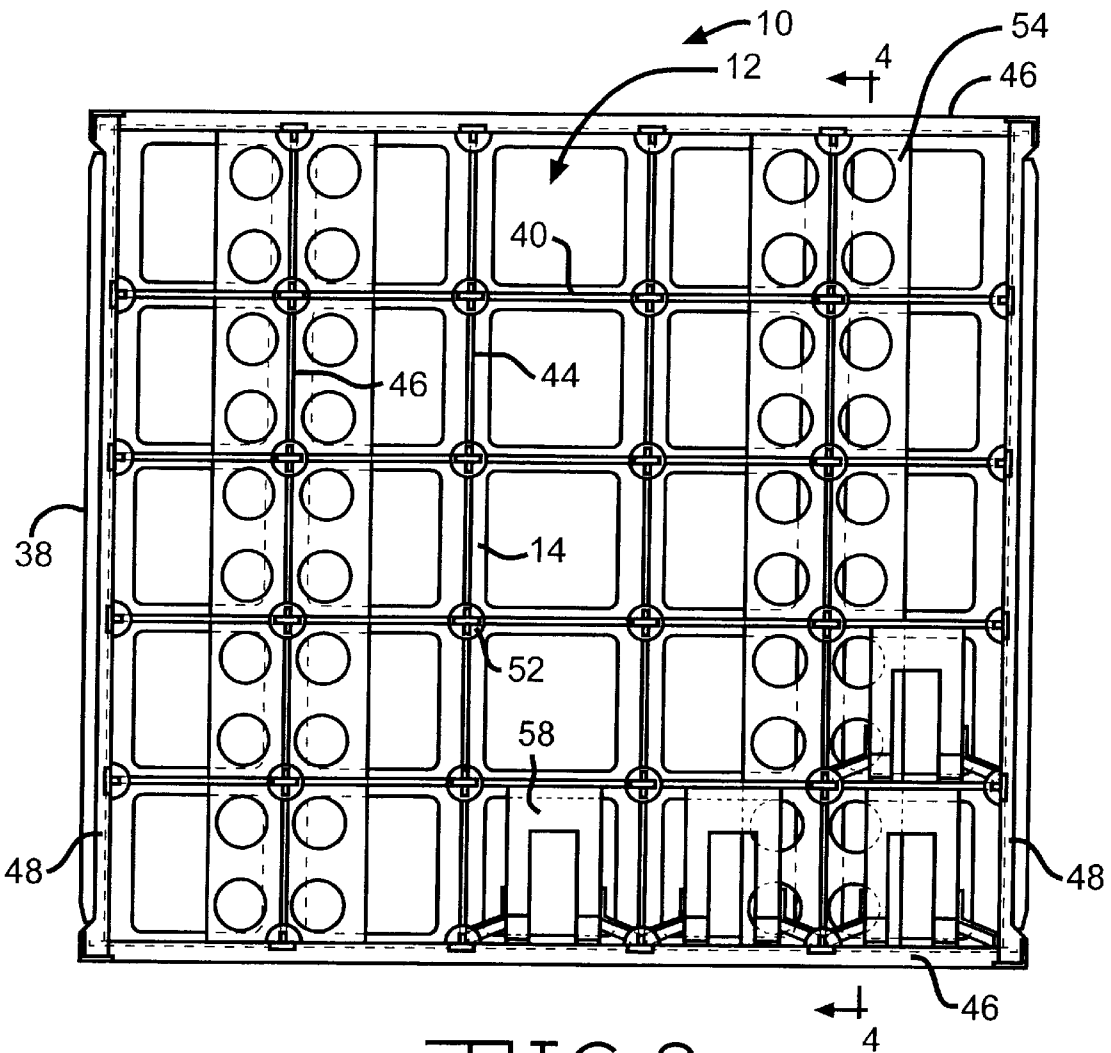
FIG. 3 is a top view of the container 10.
Figure 4:
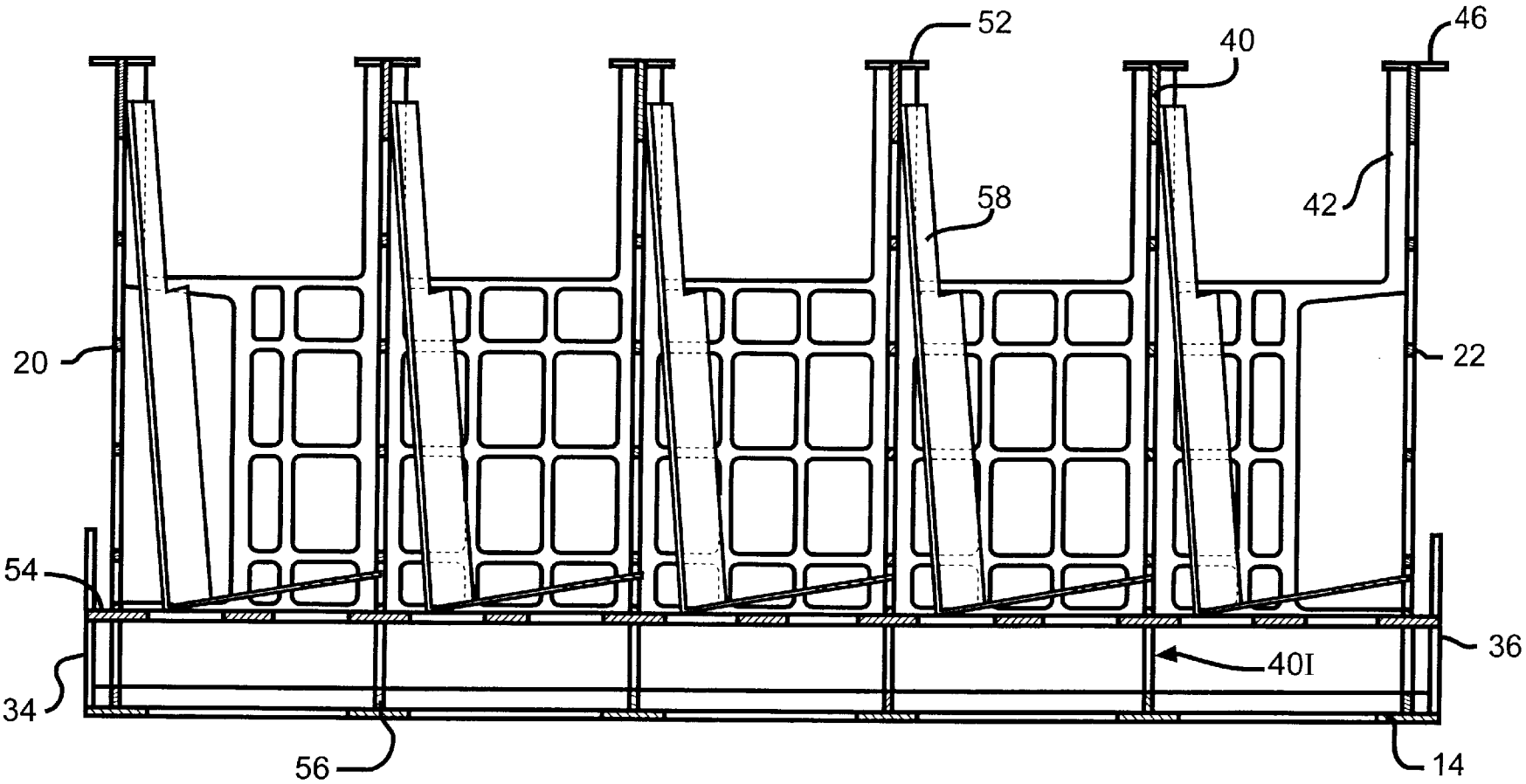
FIG. 4 is a sectional view along the line 4—4 of FIG. 3 showing the guide cradles 58 in the compartments 12, the inner dividers 42 and 44 have been eliminated for clarity.
Figure 12:
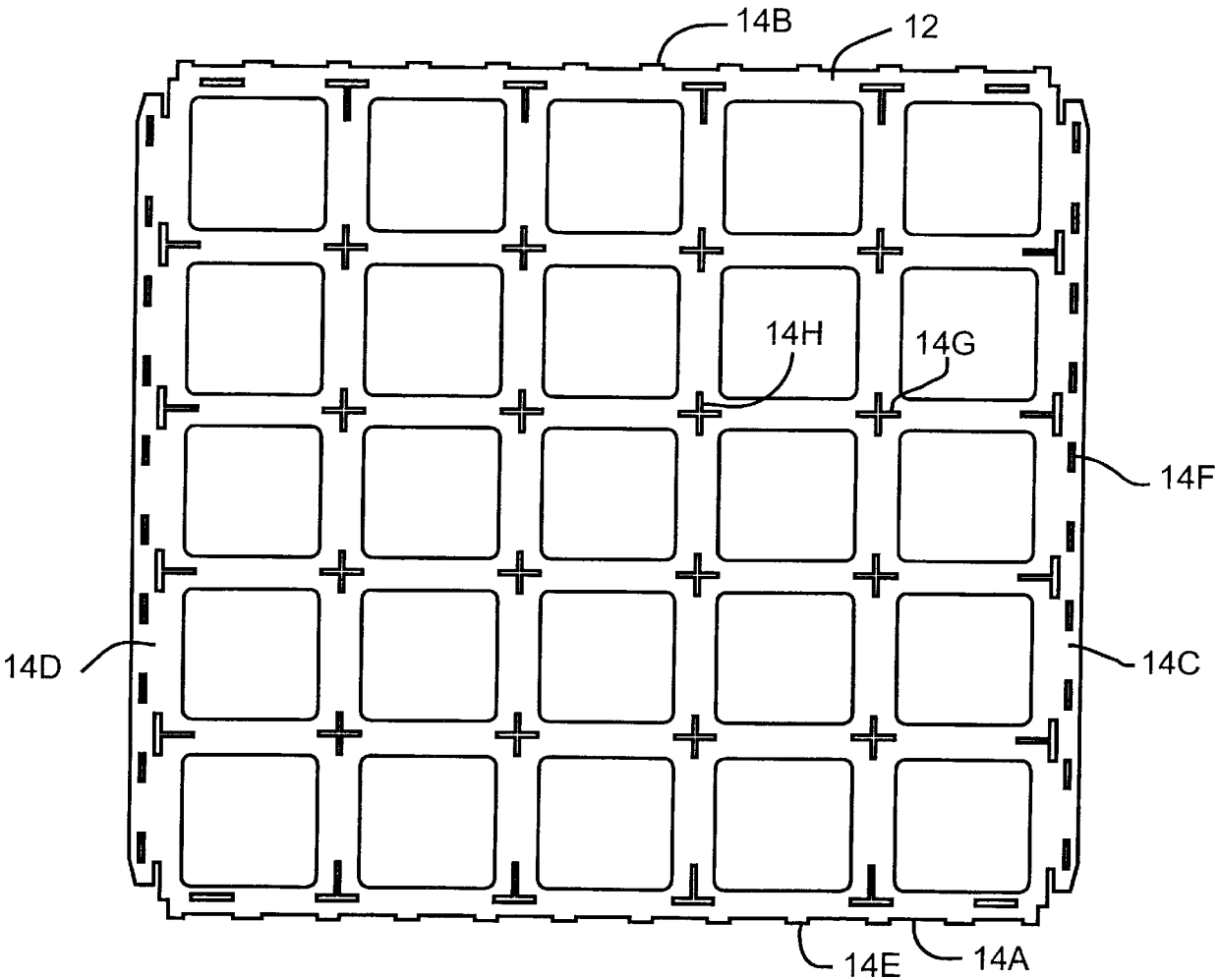
FIG. 12 is a top view of the bottom plate 14.
Figure 13:
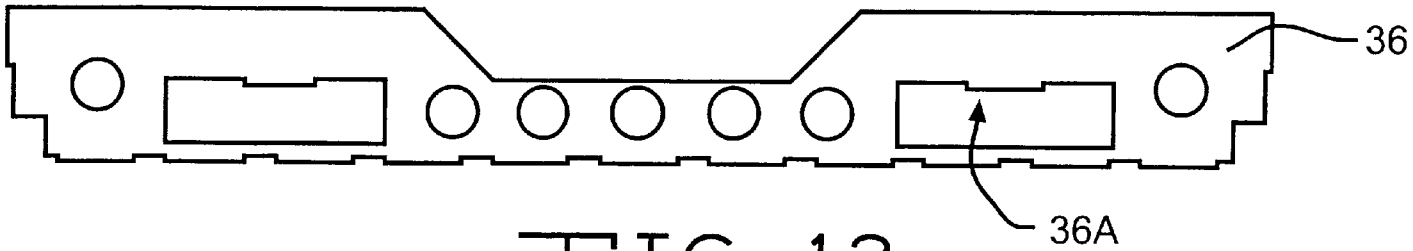
FIG. 13 is a front view of the back guard 36.
Figure 14:
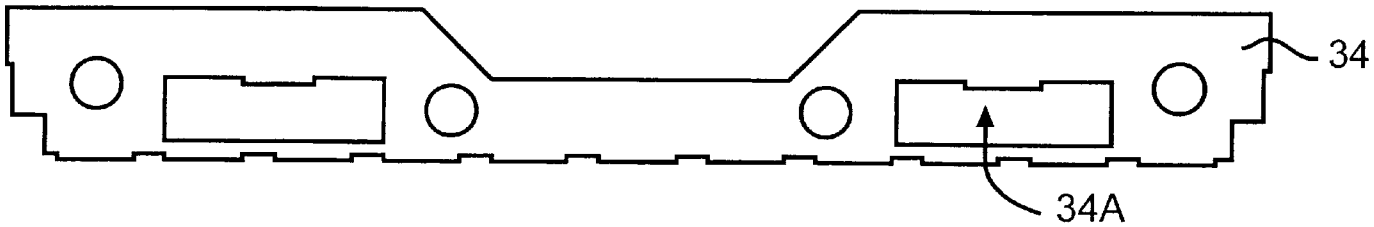
FIG. 14 is a front view of the front guard 34.
Figure 15:
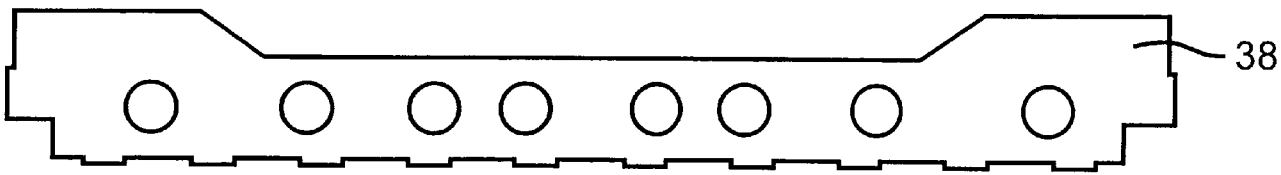
FIG. 15 is a front view of one of the side guards 38.

FIGS. 1 to 3 show the container 10 of the present invention. The container 10 includes a bottom plate 14, front and back end walls 20 and 22 and opposed right and left sidewalls 30 and 32. The container 10 uses a tab and slot construction to form an egg crate design. In one (1) embodiment, the bottom plate 14 has an essentially rectangular shape with front and back edges or ends 14A and 14B and opposed right and left edges or sides 14C and 14D (FIG. 12). The bottom plate 14 includes guard mounting tabs 14E along the front and back edges 14A and 14B and guard mounting slots 14F along the left and right side edges 14C and 14D. The guard mounting slot and tabs 14F and 14E allow for attaching the front, back and side guards 34, 36 and 38 to the bottom plate 14. The bottom plate 14 has a series of first mounting slots 14G extending parallel to the front and back edges 14A and 14B and a series of second mounting slots 14H extending parallel to the sides 14C and 14D of the bottom plate 14. The first mounting slots 14G are arranged in lines extending between the right and left edges 14A and 14B of the bottom plate 14. The second mounting slots 14H are arranged in lines extending between the front and back edges 14A and 14B of the bottom plate 14. The first and second mounting slots 14G and 14H intersect at various points on the bottom plate 14 and form cross-shaped openings. In one (1) embodiment, the intersection of the mounting slots 14G and 14H nearest the edges 14A and 14B form T-shaped openings with the mounting slots 14G and 14H parallel to the adjacent edge forming the top of the T-shaped openings.

Figure 6:
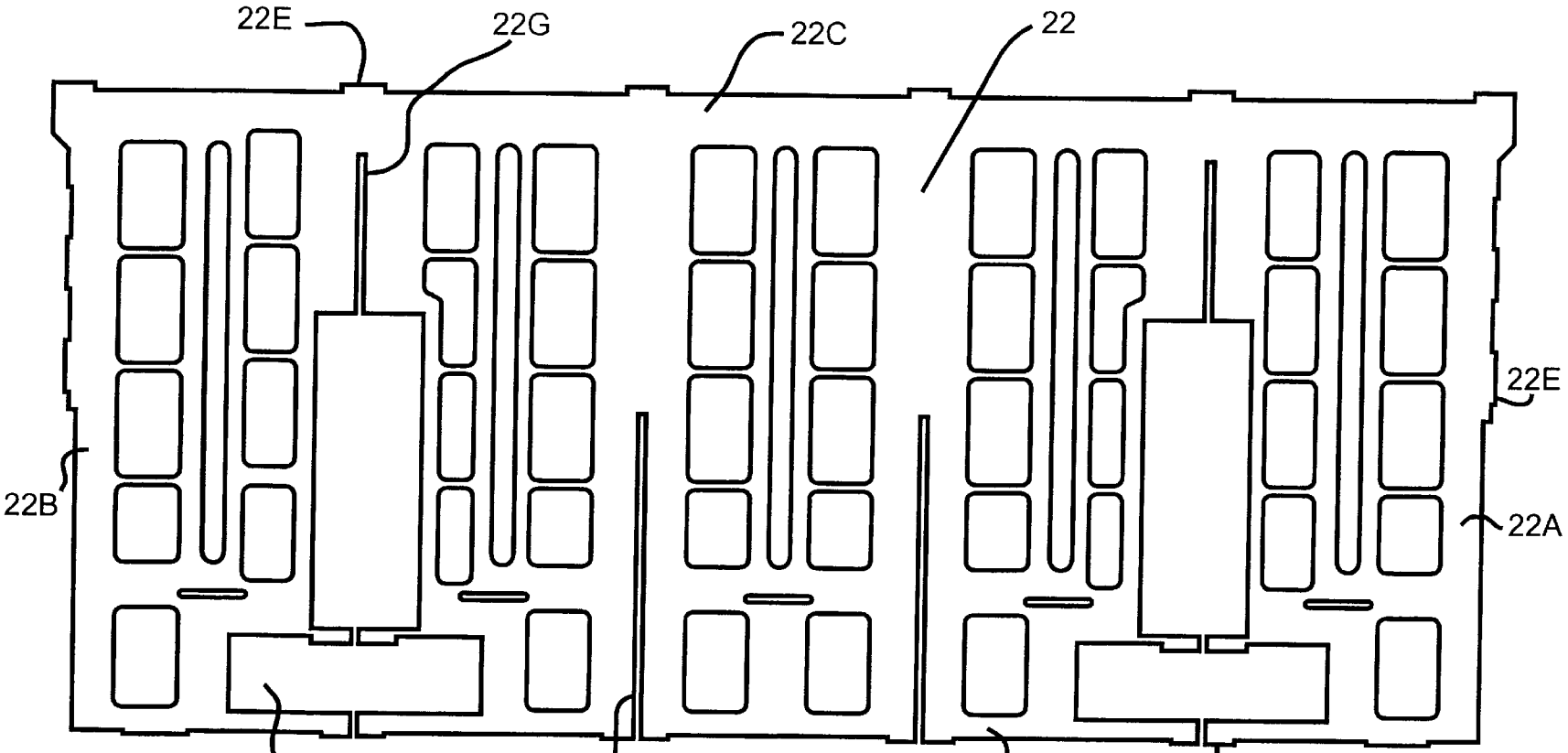
FIG. 6 is a rear view of the back end wall 22.
Figure 8:
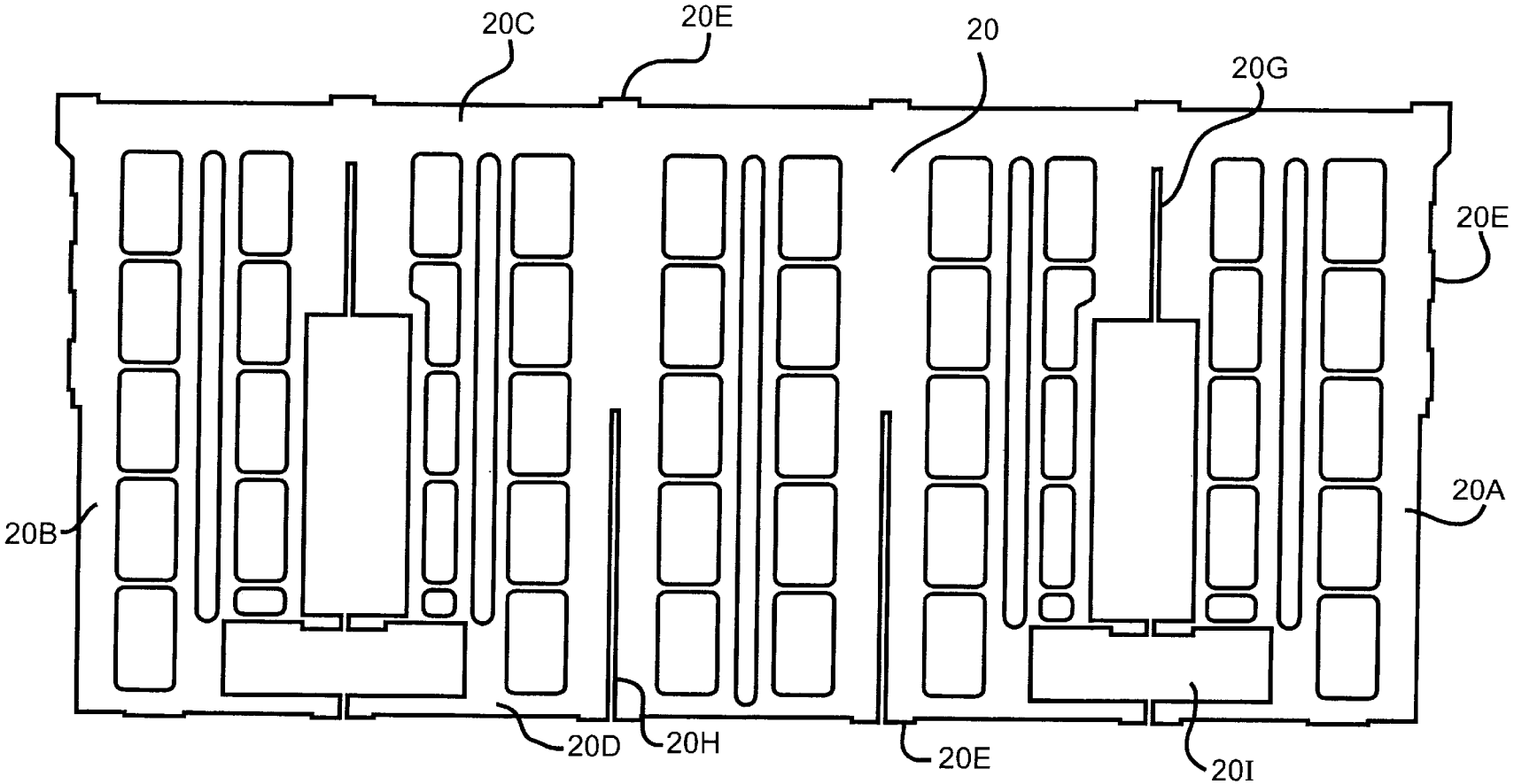
FIG. 8 is a front view of the front end wall 20.

The front or first end wall 20 is mounted on the front edge 14A of the bottom plate 14. The back or second end wall 22 is mounted on the back edge 14B of the bottom plate 14. In one (1) embodiment, the front end wall 20 and the back end wall 22 have essentially the same shape and size (FIGS. 6 and 8). The end walls 20 and 22 have an essentially rectangular shape with first and second ends 20A, 22A and 20B, 22B and first or top side and second or bottom side 20C, 22C and 20D, 22D extending therebetween. In one (1) embodiment, the end walls 20 and 22 have a length between the ends 20A and 20B and 22A and 22B essentially equal to the length of the front or back edges 14A and 14B of the bottom plate 14. The end walls 20 and 22 are provided with mounting tabs 20E and 22E along the ends 20A, 20B and 22A, 22B and the sides 20C and 20D and 22C, 22D. In one (1) embodiment, the end walls 20 and 22 have mounting tabs 20E and 22E only on the upper portion adjacent the top side 20C and 22C of the end walls 20 and 22. The end walls 20 and 22 have open ended vertical slots 20G, 20H and 22G, 22H which extend from the bottom or second side 20D and 22D up toward the first side 20C or 22C essentially parallel to the ends 20A, 22A and 20B, 22B. The bottom end of the slots 20G, 20H and 22G, 22H adjacent the bottom side 20D and 22D of the end walls 20 and 22 are open. In one (1) embodiment, the end walls 20 and 22 have outer slots 20G and 22G and inner slots 20H and 22H. The outer slots 20G and 22G are adjacent to but spaced apart from the ends with the inner slots 20H and 22H spaced between the outer slots 20G and 22G. The outer slots 20G and 22G extend from the bottom side 20D or 22D of the end wall 20 or 22 to slightly below the top side 20C or 22C of the end wall 20 or 22. The inner slots 20H and 22H extend from the bottom side 20D or 22D about half the distance to the top side 20C or 22C of the end wall 20 or 22. The number of inner slots 20H and 22H depends on the number of inner dividers 44 which depends on the size of the container 10 and the number of compartments 12. In one (1) embodiment, the front and back end walls 20 and 22 are provided with a pair of lift openings 20I and 22I adjacent the bottom side 20D and 22D and adjacent each end. In one (1) embodiment, the lift openings 20I and 22I are positioned such that each of the outer slots 20G and 22G bisects one (1) of the lift openings 20I or 22I. The lift openings 20I and 22I preferably have a rectangular shape and are of such a size as to easily accommodate a tine of a forklift (not shown). In one (1) embodiment, the back end wall 22 is also provided with a series of guide slots. The guide slots extend horizontally, parallel to the sides 22C and 22D of the back end wall 22. The guide slots allow for securing the guide cradles 58 in the compartments 12.

Figure 7:
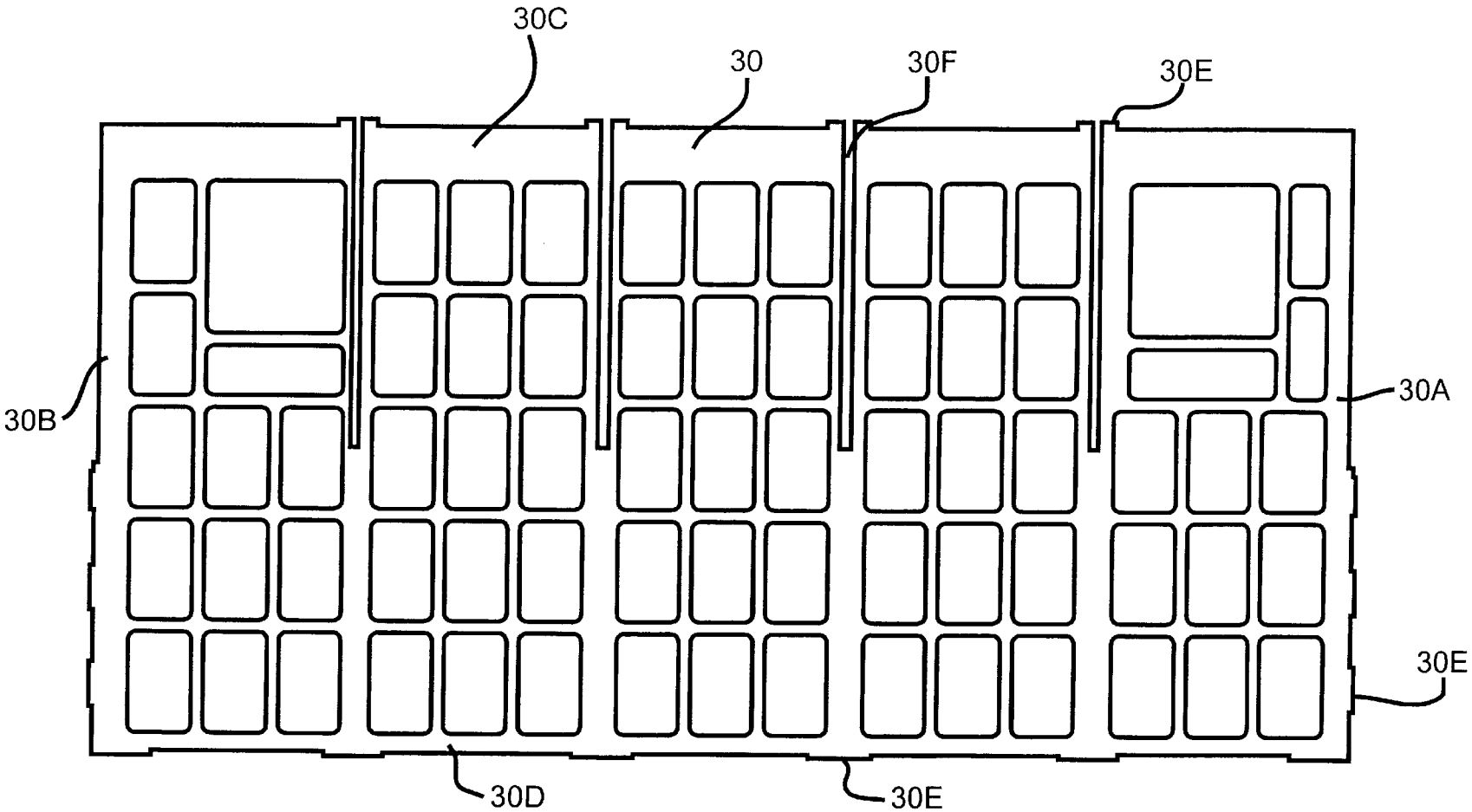
FIG. 7 is a side view of the right sidewall 30.

The right and left sidewalls 30 and 32 are mounted along the right and left edges 14A and 14B, respectively of the bottom plate 14. In one (1) embodiment, the right sidewall 30 has a length essentially equal to the length of the side edges 14A and 14B of the bottom plate 14. The right and left sidewalls 30 and 32 are preferably identical and therefore, only the right sidewall 30 will be discussed in detail (FIG. 7). The right sidewalls 30 have an essentially rectangular shape with first and second ends 30A and 30B and first and second or top and bottom sides 30C and 30D extending between the ends 30A and 30B. The right sidewall 30 is provided with mounting tabs 30E along the ends 30A and 30B and sides 30C and 30D. In one (1) embodiment, the ends 30A and 30B have mounting tabs 30E only adjacent the bottom side 30D and 32D of the sidewalls 30 and 32. The right sidewall 30 has open ended vertical slots 30F which extend downward from the top side 30C parallel to the ends 30A and 30B. The top end of the slots 30F adjacent the top side 30C of the sidewall 30 are open.

In one (1) embodiment, the bottom plate 14 is slightly greater in width between the front and back edges 14A and 14B than the length of the sidewalls 30 and 32 and is slightly greater in length between the side edges 14C and 14D than the length of the front and back end walls 20 and 22. Thus, when the front and back end walls 20 and 22 and the sidewalls 30 and 32 are positioned on the bottom plate 14, the edges 14A, 14B, 14C and 14D of the bottom plate 14 extend slightly beyond the front and back end walls 20 and 22 and the sidewalls 30 and 32. Front, back and side guards 34, 36 and 38 are mounted on the bottom plate 14 adjacent the second sides 20D, 22D and 30D of the front and back end walls 20 and 22 and the sidewalls 30 and 32, respectively. The guards 34, 36 and 38 are spaced outside the walls 20, 22, 30 and 32 around a perimeter of the container 10. The guards 34, 36 and 38 protect the walls 20, 22, 30 and 32 of the container 10 particularly during lifting and moving. The front and back guards 34 and 36 have lift openings 34A and 36A which correspond to the lift openings 20I and 22I in the front and back end walls 20 and 22.

Figure 9:
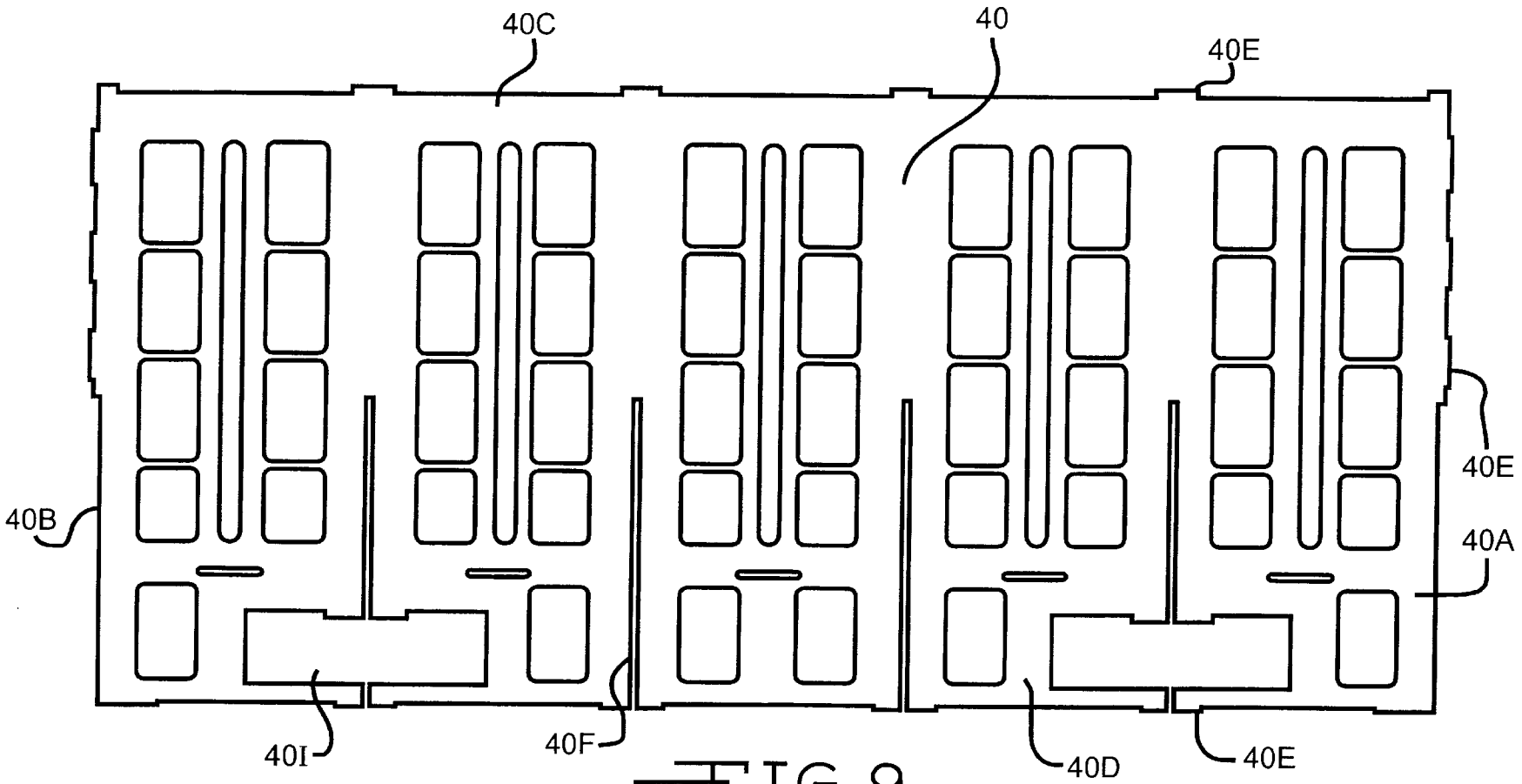
FIG. 9 is a front view of the first divider 40.
Figure 10:
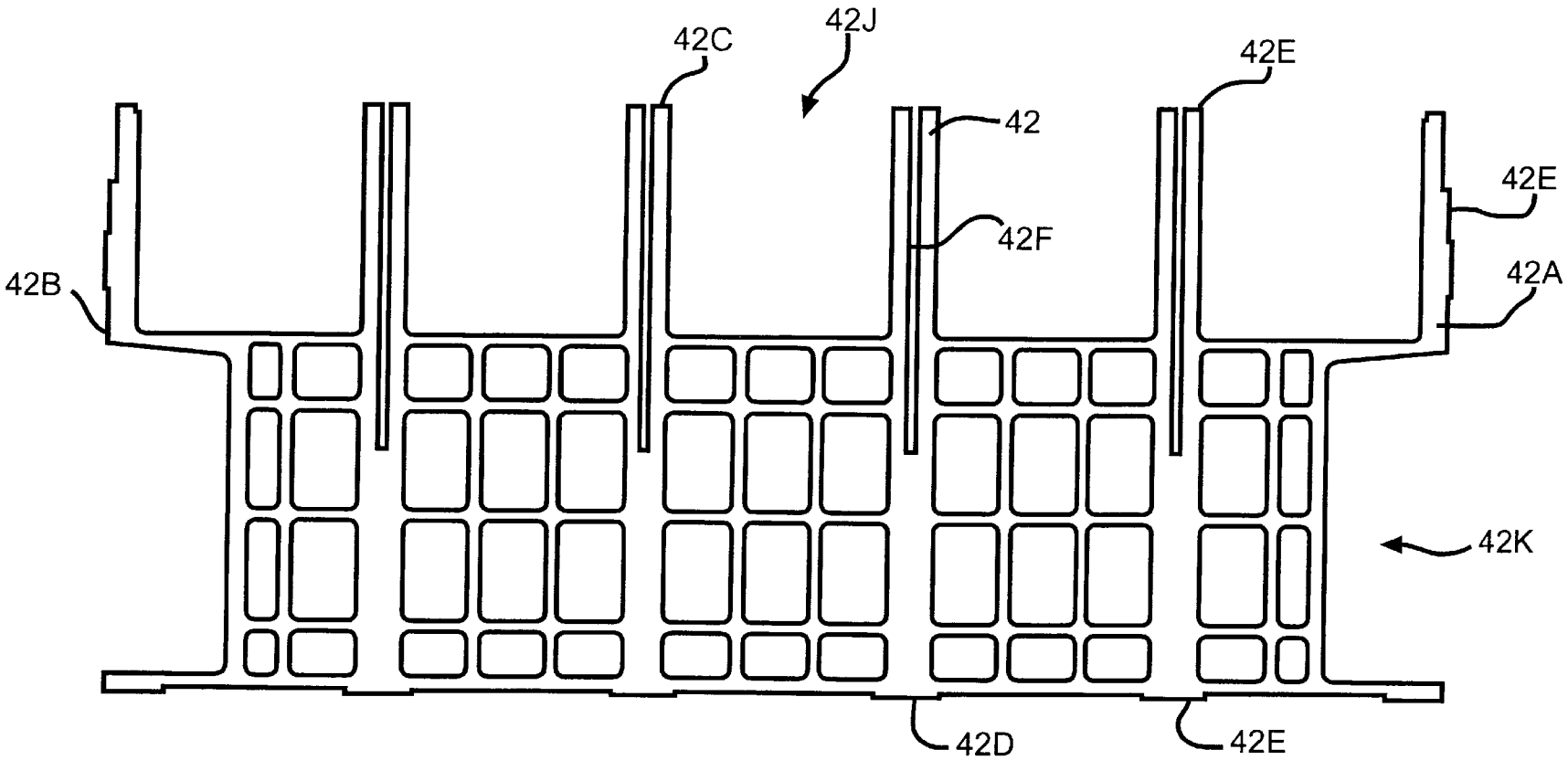
FIG. 10 is a front view of the outer divider 42.
Figure 11:
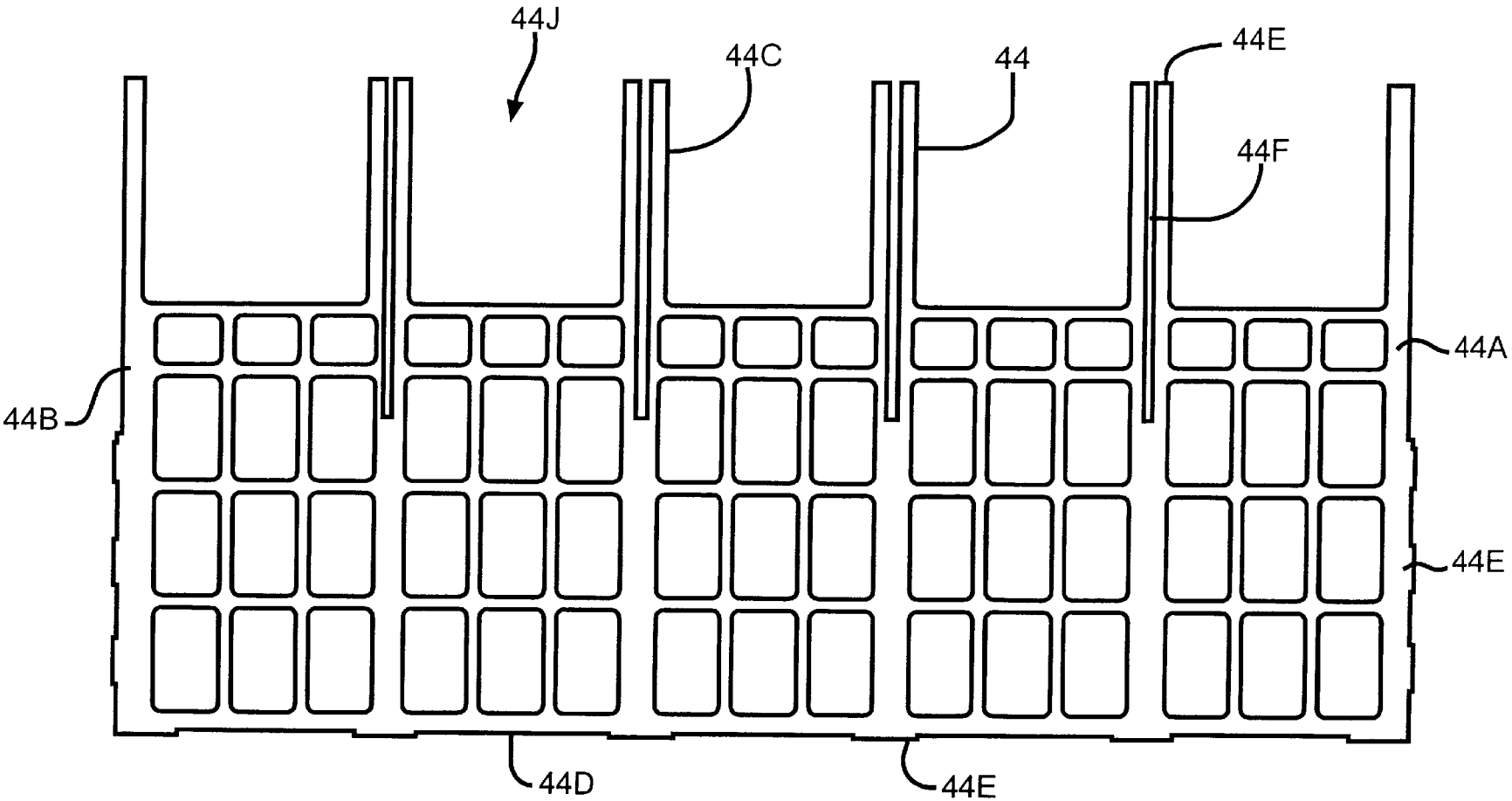
FIG. 11 is a front view of the inner divider 44.

The container 10 includes a plurality of first dividers 40 and second dividers 42 and 44 (FIGS. 9 to 11). The first dividers 40 extend between the opposed sidewalls 30 and 32 spaced between and essentially parallel to the end walls 20 and 22. The second dividers 42 and 44 extend between the opposed front and back end walls 20 and 22 spaced between and essentially parallel to the sidewalls 30 and 32. The dividers 40 and 42 and 44 divide the interior of the container 10 into a plurality of compartments 12. Each compartment 12 is of a size as to fit the part to be treated. The number of the first and second dividers 40 and 42 and 44 can be varied to vary the size and shape of the compartments 12 as necessary to accommodate a specific part. In one (1) embodiment, the container 10 is designed to hold cylinder heads for automobiles. The first dividers 40 are preferably essentially similar in shape and size to the end walls 20 and 22 (FIG. 9). The first dividers 40 have an essentially rectangular shape with first and second ends 40A and 40B and first and second or top and bottom sides 40C and 40D extending therebetween. The first dividers 40 are provided with mounting tabs 40E along the ends 40A and 40B and the sides 40C and 40D. In one (1) embodiment, the ends 40A and 40B have mounting tabs 40E only on the upper portion adjacent the top side 40C of the first divider 40. The first divider 40 has open ended vertical slots 40F which extend from the bottom side 40D up toward the top side 40C essentially parallel to the ends 40A and 40B. The slots 40F are preferably similar to the inner slots 20H and 22H of the end walls 20 and 22. The first dividers 40 are provided with a pair of lift openings 40I adjacent the bottom side 40D, adjacent each of the sides 40C and 40D. When the first dividers 40 are correctly positioned between the sidewalls 30 and 32, the vertical slots 40F of the first dividers 40 correspond with the vertical slots 20G, 20H and 22G, 22H of the end walls 20 and 22, the lift openings 40I of the first dividers 40 correspond to the lift openings 20I and 22I of the end walls 20 and 22. The second dividers 42 and 44 have an essentially rectangular shape with first and second ends 42A, 44A and 42B, 44B and first and second or top and bottom sides 42C, 44C and 42D, 44D extending therebetween (FIGS. 10 and 11). The second dividers 42 and 44 have mounting tabs 42E and 44E along the ends 42A, 44A and 42B, 44B and the sides 42C, 44C and 42D, 44D. The second dividers 42 and 44 have open ended vertical slots 42F and 44F which extend downward from the top side 42C and 44C toward the bottom side 42D and 44D of the second dividers 42 and 44. The top side 42C and 44C of the second dividers 42 and 44 has a series of top notches 42J and 44J spaced between the slots 42F and 44F. The sections of the top side 42C and 44C between the top notches 42J and 44J includes the open end of the vertical slots 42F and 44F and form the mounting tabs 42E and 44E for the top side 42C and 44C of the second divider 42 and 44. The top notches 42J and 44J have a width essentially equal to the length of one (1) side of the compartment 12. The top notches 42J and 44J reduce the height of the sides of the compartment which allows for easier access into the compartments 12. In one (1) embodiment, the second dividers include outer dividers 42 and inner dividers 44 (FIGS. 10 and 11). In one (1) embodiment, there are two (2) outer dividers 42, one (1) positioned adjacent each of the sidewalls 30 and 32 of the containers 10 (FIG. 10). The inner dividers 44 are spaced between the outer dividers 42 (FIG. 11). The number of inner dividers 44 depends on the number of compartments 12 needed in the container 10. The outer dividers 42 have end notches 42K in the ends 42A and 42B adjacent the bottom side 42D of the outer divider 42 (FIG. 10). The upper portion of the ends 42A and 42B between the top side 42C and the end notch 42K is provided with mounting tabs 42E. The outer dividers 42 are shorter than the walls 20, 22, 30 and 32 of the container 10 such that the outer divider 42 does not extend completely to the bottom plate 14. When the outer divider 42 is correctly positioned, the top side 42C of the outer divider 42 is adjacent the top side 20C, 22C and 30C of the walls 20, 22, 30 and 32 and the bottom side 42D of the outer dividers 42 is spaced above the bottom plate 14. In one (1) embodiment, the inner dividers 44 are similar to the outer dividers 42 except that they do not have end notches. In this embodiment, the inner dividers 44 have mounting tabs 44E on the lower portion of the ends 44A and 44B adjacent the bottom side 44D of the inner divider 44.

Figure 17:
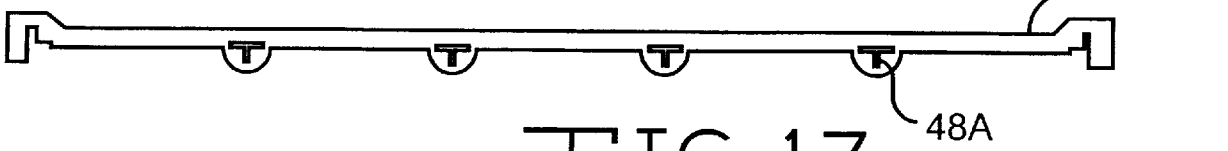
FIG. 17 is a top view of the right or left side top rail 48.
Figure 18:
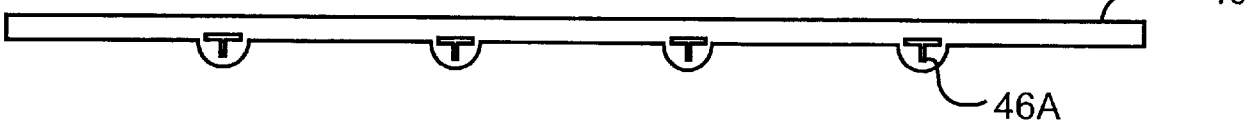
FIG. 18 is a top view of the front or back top rail 46.
Figure 19:
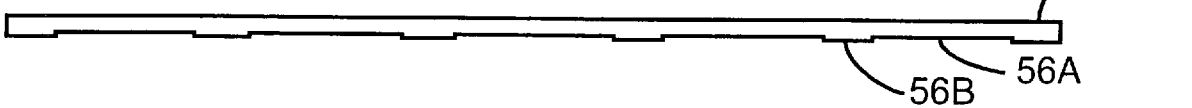
FIG. 19 is a view of one of the stiffening members 56.
Figure 21:
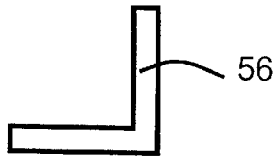
FIG. 21 is a top view of the stacking bracket 50.
Figure 23:
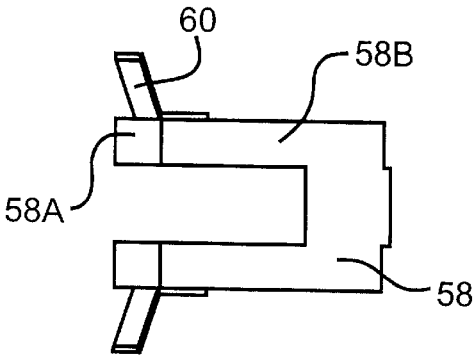
FIG. 23 is a top view of one of the guide cradles 58.
Figure 22:
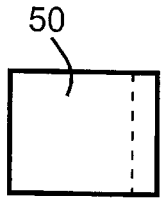
FIG. 22 is an end view of one of the stacking brackets 50.

The container 10 includes first top rails 46 which extend along the top sides 20C and 22C of the front and back end walls 20 and 22 (FIG. 18) and second top rails 48 which extend along the top side 30C of the sidewalls 30 and 32 (FIG. 17). In one (1) embodiment, the top rails 46 and 48 have slots 46A and 48A which slide over mounting tabs 20E and 22E along the top sides 20C and 22C of the end walls 20 and 22 and sidewalls 30 and 32 and the mounting tabs 40E, 42E and 44E of the top side 40C, 42C and 44C of the dividers 40, 42 and 44 adjacent the ends 40A, 42A, 44A, 40B, 42B and 44B of the dividers 40, 42 and 44. In another embodiment, the top rails 46 and 48 are welded to the top sides 20C, 22C, 30C, 40C, 42C and 44C of the end walls 20 and 22, sidewalls 30 and 32 and dividers 40, 42 and 44. The top rails 46 and 48 intersect at the corners of the container 10 and are secured together such as by welding. In one (1) embodiment, the top rails 46 and 48 have a length greater than the length of the front and back end wall 20 and 22 and the sidewalls 30 and 32 such that the corners formed by the intersecting top rails 46 and 48 extend beyond the corners of the container 10 formed by the walls 20 and 22. In one (1) embodiment, stacking brackets 50 are mounted on the ends of the top rails 46 and 48 at each corner of the container 10 (FIGS. 1 and 2). The stacking brackets 50 preferably have an angle iron shape with two (2) legs connected together at a 90° angle (FIGS. 21 and 22). The stacking brackets 50 are positioned such as to form an extension above the top rails 46 and 48 of the container 10 which forms a corner spaced above and outward from the corner of the container 10. The stacking brackets 50 allow for stacking the containers 10 vertically top to bottom.

Figure 20:
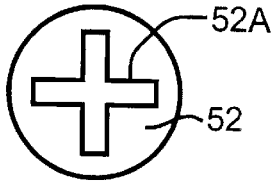
FIG. 20 is a view of one of the securing disks 52.

Securing disks 52 are provided at the intersection of the mounting tabs 40E, 42E and 44E on the top sides 40C, 42C and 44C of the first and second dividers 40, 42 and 44 (FIG. 20). The disks 52 have a circular shape with a pair of slots 52A which form a cross in the center of the disk 52. The disk 52 is slid down over the intersection of the first and second dividers 40, 42 and 44 such that the mounting tabs 40E, 42E and 44E on the top sides 40C, 42C and 44C of the dividers 40, 42 and 44 extend through the slots 52A. The disks 52 are then secured in place such as by welding. The disks 52 and top rails 46 and 48 assist in holding the front and back walls 20 and 22, the sidewalls 30 and 32 and the first and second dividers 40, 42 and 44 together.

Figure 5:
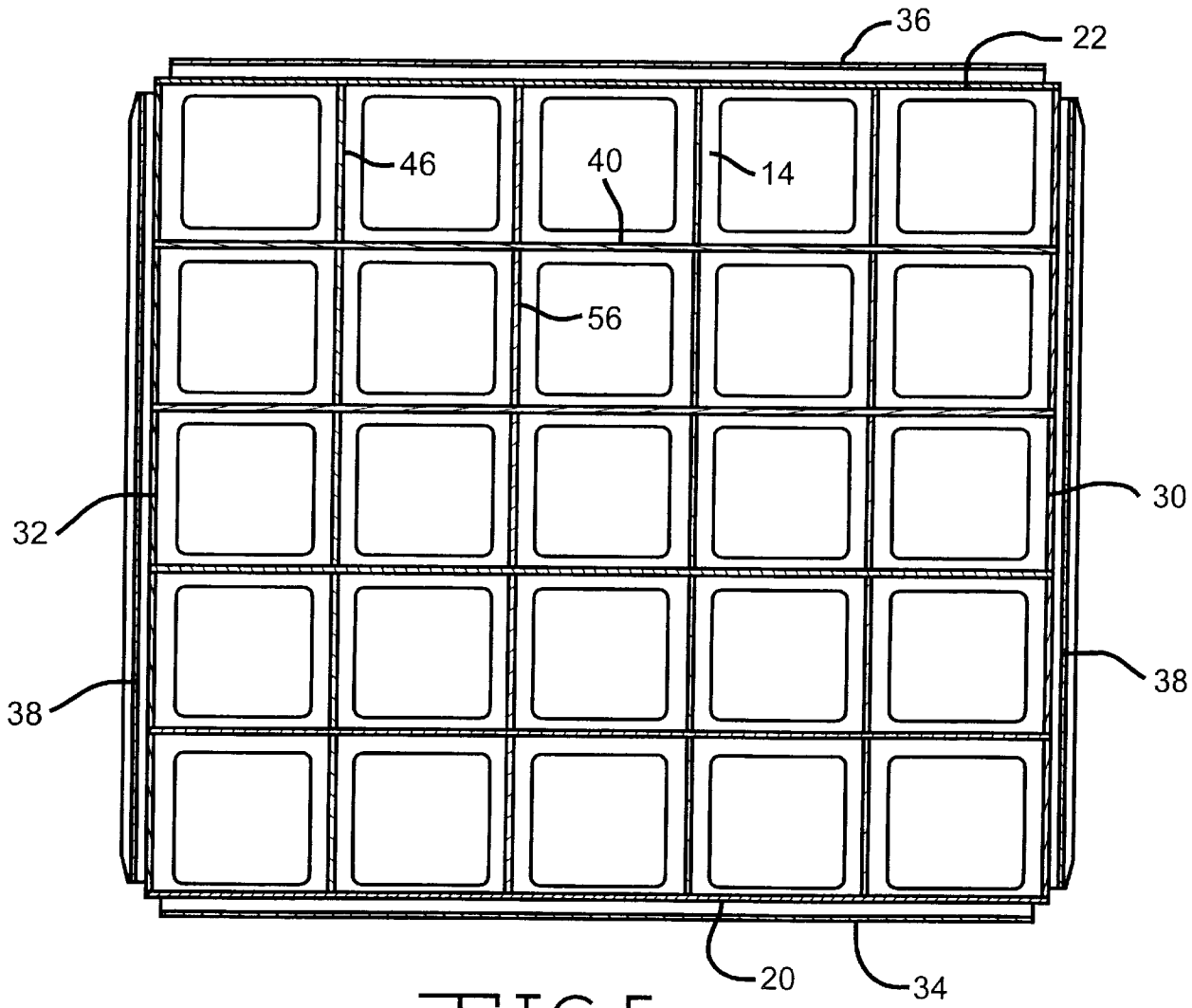
FIG. 5 is a sectional view along the line 5—5 of FIG. 1 showing the stiffeners 56 and the bottom plate 14.
Figure 16:
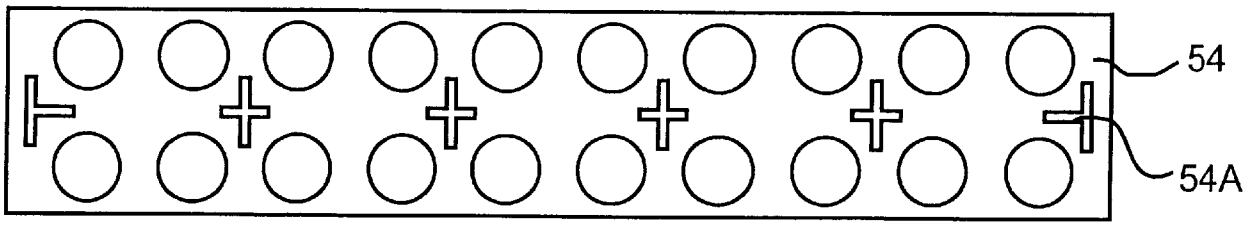
FIG. 16 is a top view of one of the protector plates 54.

In one (1) embodiment, protector plates 54 (FIG. 16) are provided adjacent the bottom side 44D of the outer dividers 44 adjacent the lift openings 20I, 22I and 40I in the front and back walls 20 and 22 and the first dividers 40. The protector plates 54 have a rectangular shape and extend the complete width of the bottom plate 14 between the front and back edges 14A and 14B. Thus, the ends of the protector plates 54 extend through the lift openings 20I and 22I in the front and back end walls 20 and 22 to the lift openings 34A and 36A in the front and back guard members 34 and 36. The protector plates 54 have mounting slots 54A which receive the mounting tabs 44E along the bottom side 44D of the outer divider 44 and along the top edge of the lift openings 40I of the first dividers 40. The protector plates 54 preferably have a width essentially equal to the width of the tines of the forklift. In one (1) embodiment, the outer dividers 44 are positioned in the center of the lift openings 20I, 22I and 40I an equal distance from each end of the openings 20I, 22I and 40I. In this embodiment, the protector plates 54 are positioned such that the outer dividers 44 extend along the center of the protector plates 54. In one (1) embodiment, stiffening brackets 56 are positioned on the bottom plate 14 in the same plane as the outer dividers 44 (FIG. 5). The stiffeners have mounting tabs 56A along the bottom side 56B which mount in the second mounting slots 14H in the bottom plate 14. The stiffening brackets 56 extend upward from the bottom plate 14 toward the bottom side 44D of the outer dividers 44 and have a height such as to not extend into the area accessed by the lift openings 20I, 22I, 34A, 36A and 40I in the front and back end walls 20 and 22, the front and back guard members 34 and 36 and the first dividers 40.

Figure 24:
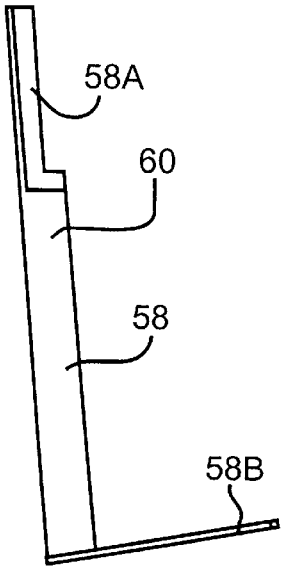
FIG. 24 is a side view of one of the guide cradles 58.
Figure 25:
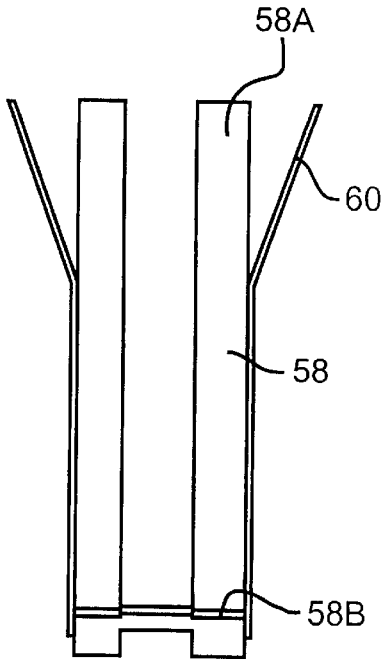
FIG. 25 is a front view of one of the guide cradles 58.

In one (1) embodiment, guide cradles 58 are mounted in each of the compartments 12. The guide cradles 58 assist in centering the parts in the compartments 12. The shape, size and positioning of the guide cradles 58 in the compartments 12 depends on the type of part which is to be positioned in the compartments 12. In one (1) embodiment, the container 10 is used for heat treating cylinder heads for automobiles. In this embodiment, the guide cradles 58 are preferably secured to the first dividers 40 and the front or back end walls 20 or 22 of the container 10. The guide cradles 58 are positioned between the front wall 20 or back wall 22 and the adjacent first divider 40. In this embodiment, the guide cradle 58 is formed by a pair of spaced apart legs having a top portion 58A and a bottom portion 58B. The bottom portion 58B extends outward from the top portion 58A at an angle such that the guide cradle 58 has an essentially L-shape (FIG. 24). The angle between the top portion 58A and the bottom portion 58B is preferably less than 90°. The bottom ends of the legs are secured together such that the bottom portion 58B of the guide cradle 58 has a U-shape. The guide cradle 58 also includes a pair of positioners 60 mounted on the top portion 58A of the legs. The positioners 60 extend outward perpendicular to the top section of the legs in the same direction as the bottom section of the legs. The positioners 60 include a top section and a bottom section. In one (1) embodiment, the bottom section of the positioner 60 has a width greater than the top section. The positioners 60 are mounted on the legs such that the bottom section of the positioners 60 is adjacent the bottom portion of the legs. The top section of the positioner 60 is preferably angled such as to extend outward away from the leg on which the positioner 60 is mounted in a direction away from the other leg. The top portion 58A of the guide cradle 58 is secured in the compartment 12 to one (1) side of the first dividers 40 or one (1) side of the front or back end walls 20 or 22 of the container 10. The bottom portion of the guide cradle 58 is mounted to the other side of the first divider 40 or the other side of the front or back end walls 20 or 22. The width of the cradle guide 58 across the top, between the outwardly angled top sections of the positioners 60, is such that the guide cradle 58 extends the entire width of the compartment 12. The length of the top portion 58A and the angle between the top portion 58A and the bottom portion 58B is such that the guide cradle 58 is spaced above the bottom plate 14 of the container 10. Thus, when the part is positioned in the guide cradle 58, in the compartment 12, the part is spaced above the bottom plate 14 of the container 10. The spacing of the guide cradle 58 above the bottom plate 14, allows forklift tines to be inserted through the container 10 between the bottom plate 14 of the container 10 and the guide cradles 58 and the parts such that the parts are not damaged during transport of the container 10.

In one (1) embodiment, the various pieces of the container 10 are constructed of hot rolled, pickled and oiled steel. However, the container 10 can be constructed of any durable material which can withstand the vast temperature changes associated with the heat treating process. The bottom plate 14, walls 20 and 22, dividers 40, 42 and 44 and protector plate 54 are provided with holes to reduce the weight of the container 10 and allow easier access to the parts during the heat treating process. In one (1) embodiment, the pieces used to construct the container 10 including the bottom plate 14, the top rails 46 and 48, the securing disks 52, the walls 20 and 22 and 30 and 32 and the dividers 40, 42 and 44 are constructed from flat pieces which have less final warpage after each heat treating session. The pieces are cut to the correct shape and size using any well known method which minimizes the amount of heat affected zones on the pieces. In one (1) embodiment, the pieces are cut at high speed using a laser which reduces heat penetration during cutting. By reducing the number of heat affected zones, the pieces are less likely to warp during use of the container 10.

To construct the container 10, the sidewalls 30 and 32 are positioned with the bottom sides 30D adjacent the side edges 14C and 14D of the bottom plate 14. The sidewalls 30 and 32 are positioned such that the mounting tabs 30E on the bottom side 30D of the sidewalls 30 and 32 interlock with the second mounting slots 14H adjacent the side edges 14C and 14D of the bottom plate 14. Once correctly positioned, the mounting tabs 30E are secured in the second mounting slots 14H. The stiffener brackets 56 are positioned on the bottom plate 14 such that the mounting tabs 56A of the bottom side 56B of the stiffening brackets 56 extend into the second mounting slots 14H directly adjacent the sidewalls 30 and 32. Next, the mounting tabs 42E on the bottom side 42D of the inner dividers 42 are then inserted into the second mounting slots 14H in the bottom plate 14 spaced between the stiffening brackets 56. The inner dividers 42 are positioned such as to extend upward perpendicular to the bottom plate 14 and parallel to the sidewalls 30 and 32 and stiffening brackets 56. Once correctly positioned, the mounting tabs 42E are secured into the mounting slots 14H. The front and back end walls 20 and 22 are then positioned on the front and back edges 14A and 14B, respectively of the bottom plate 14. The open ended vertical slots 20G, 20H, 22G and 22H on the front and back walls 20 and 22 are slid over the mounting tabs 42E on the upper portion of the inner dividers 42 and the ends of the stiffening brackets 56. The mounting tabs 30E on the ends 30A, 30B of the sidewalls 30 and 32 are interlocked with the tabs 20E and 22E on the ends 20A, 20B, 22A and 22B of the end walls 20 and 22. Next, the outer dividers 44 are mounted between the front and back end walls 20 and 22. The outer dividers 44 are inserted into the container 10 and are slid upward toward the first end 20A and 22A of the end walls 20 and 22 until the mounting tabs 44E on the ends 44A and 44B of the outer dividers 44 are secured in the vertical slots 20G, 20H, 22G and 22H of the end walls 20 and 22. The protector plates 54 are then positioned on the bottom end 44B of the outer dividers 44 between the end walls 20 and 22 at the top of the lift openings 20I and 22I. The first dividers 40 are mounted between the sidewalls 30 and 32 of the container 10 such as to be perpendicular to the sidewalls 30 and 32 and the second dividers 42 and 44. The first dividers 40 are slid down over the second dividers 42 and 44 such that the open ended vertical slots 40F extending upward from the bottom side 40D of the first dividers 40 are matched with the open ended vertical slots 42F and 44F extending downward from the top side 42C and 44C of the second dividers 42 and 44. The first dividers 40 are slid downward until the mounting tabs 40E in the bottom side 40D of the first dividers 40 are inserted into the first mounting slots 14G in the bottom plate 14. As the first dividers 40 are moved downward, the mounting tabs 40E along the upper portion of the ends 40A and 40B of the first dividers 40 extend into the open ended vertical slots 30F extending downward from the top side 30C of the sidewalls 30 and 32. Once correctly positioned, the mounting tabs 40E are secured in the open ended vertical slots 30F in the sidewalls 30 and 32 and the mounting slots 14G in the bottom plate 14. The top rails 46 and 48 are then mounted on the top sides 20C, 22C and 30C of the end walls 20 and 22 and sidewalls 30 and 32, such that the mounting tabs 20E, 22E and 30E extend through the slots 46A and 48A in the top rails 46 and 48 and are secured in position. In one (1) embodiment, the top sides 20C, 22C and 30C of the end walls 20 and 22 and sidewalls 30 and 32 do not have tabs and the top rails 46 and 48 do not have slots 46A and 48A. In this embodiment, the top rails 46 and 48 are secured directly to the top sides 20C, 22C and 30C of the end walls 20 and 22 and sidewalls 30 and 32. Next, the securing disks 52 are mounted over the mounting tabs 40E, 42E and 44E on the top side 40C, 42C and 44C of the dividers 40, 42 and 44 at the intersection of the dividers 40, 42 and 44 and are secured in place. The mounting tabs of the various pieces of the container 10 can be secured in the corresponding mounting slot by any well known means. In one (1) embodiment, the mounting tabs are secured in the mounting slots by stitch welding which increases the flexibility of the container 10.

Once the container 10 is created, the guide cradles 58 are mounted in the compartments 12 formed in the interior of the container 10. In one (1) embodiment, the guide cradle 58 is mounted such that the top portion 58A is adjacent and in contact with the top side 40C of the first divider 40 or a front or back wall 20 or 22 which forms one (1) side of the compartment 12. The bottom portion 58B is secured to the opposite side of the compartment 12 formed by either an adjacent first divider 40 or the back or front end wall 20 or 22. The guide cradle 58 is positioned such as to be spaced above the bottom plate 14. In one (1) embodiment, the guide cradles 58 are mounted similarly in each compartment 12 such that the parts are positioned similarly facing the same direction in all compartments 12. In the compartments 12 spaced above the lift openings 20I, 22I and 40I, the protector plates 54 prevent the tines of the forklift from entering the compartment 12 and damaging the guide cradle 58 or part. When the container 10 is completely constructed with the guide cradles 58, the parts are inserted into the compartments 12. The angled upper position of the positioners 60 of the guide cradles 58 helps to guide and move the part into the guide cradle 58. Once the parts are in the container 10, the container 10 is subjected to the heat treating process. In one (1) embodiment, the container 10 with the parts is heated to approximately 960° F. and then quenched to approximately 200° F. The egg crate, interlocking construction of the container 10 and the flat, plate-like construction of the pieces of the container 10 reduces the lasting effects such as warpage of the container 10 resulting from each heat treating process. The flexible nature of the interlocking, egg crate design enables the various pieces of the container 10 to warp and then return to essentially the original shape during the various steps of the heat treating process.

It is intended that the foregoing description be only illustrative of the present invention and that the present invention be limited only by the hereinafter appended claims.

We claim:

1. A container for use during heat treating to hold a part, which comprises:

(a) a bottom plate having a plurality of edges;

(b) a first end wall mounted adjacent one of the edges of the bottom plate and extending outward from the bottom plate in a direction perpendicular to the bottom plate, the first end wall having a first end and a second end with opposed sides extending between the ends with at least one slot extending between the sides;

(c) a second end wall mounted adjacent one of the edges of the bottom plate opposite the first end wall and extending outward from the bottom plate perpendicular to the bottom plate in a direction similar to the direction of the first end wall, the second end wall having a first end and a second end with opposed sides extending between the ends with at least one slot extending between the sides;

(d) a first sidewall mounted adjacent one of the edges of the bottom plate and extending outward from the bottom plate perpendicular to the bottom plate in a direction similar to the direction of the first end wall, the first sidewall having a first end and a second end with opposed sides extending between the ends with at least one slot extending between the sides;

(e) a second sidewall mounted adjacent one of the edges of the bottom plate and extending outward from the bottom plate perpendicular to the bottom plate in a direction similar to the direction of the first end wall, the second sidewall having a first end and a second end with opposed sides extending between the ends with at least one slot extending between the sides;

(f) a first divider having opposed ends with a tab on each of the opposed ends and positioned such as to extend between the first and second sidewalls such that the tab at one end of the first divider extends into one of the slots of the first sidewall and the tab on the other end of the first divider extends into one of the slots of the second sidewall; and (g) a second divider having opposed ends with a tab on each of the opposed ends and positioned such as to extend between the first and second end walls such that the tab at one end extends into one of the slots of the first end wall and the tab on the other end extends into one of the slots of the second end wall.

2. The container of claim 1 wherein the tabs of the second divider are permanently mounted in the slots of the end walls by stitch welding.

3. The container of claim 1 wherein the tabs of the first divider are permanently mounted in the slots of the sidewalls by stitch welding.

4. The container of claim 1 wherein the first and second dividers intersect and wherein a securing disk is mounted on one of the sides of the first and second dividers opposite the bottom plate at an intersection point of the first and second dividers.

5. The container of claim 4 wherein the first and second dividers have tabs along one of the sides opposite the bottom plate at the intersection point of the first and second dividers and wherein the securing disk is mounted over the tabs to secure the first and second dividers together.

6. The container of claim 1 wherein one of the sides of the end walls and the sidewalls are stitch welded to the bottom plate.

7. The container of claim 1 wherein the ends of the sidewalls have tabs and the ends of the end walls have tabs and wherein the tabs of the sidewalls interlock with the tabs of the end walls.

8. The container of claim 1 wherein there are a plurality of second dividers, wherein the second dividers includes a pair of outer second dividers and one or more inner second dividers and wherein each of the outer second dividers is positioned adjacent one of the sidewalls and the inner second dividers are positioned such that the outer second dividers are spaced between the sidewalls and the inner second dividers.

9. The container of claim 8 wherein the outer second dividers are shorter in height than the end walls and sidewalls such that the outer second dividers do not extend completely to the bottom plate.

10. The container of claim 1 wherein the end walls and the sidewalls have essentially a same height.

11. The container of claim 1 wherein the first divider has a first side and a second side extending between the ends with a slot extending from the second side toward the first side, wherein the second divider has a first side and a second side extending between the ends with a slot extending from the first side toward the second side and wherein the first and second dividers are interlocked together such that the slot of the first divider is in the slot of the second divider.

12. The container of claim 1 wherein the first and second dividers intersect and form compartments, wherein a guide cradle is mounted in the compartments and wherein the guide cradle is configured to space the part above the bottom plate.

13. The container of claim 12 wherein the guide cradle has an L-shape with a first leg and a second leg and wherein side guides are mounted along sides of the first leg to guide the part onto the guide cradle.

14. The container of claim 1 wherein the bottom plate has slots parallel adjacent the edges, wherein the sidewalls and end walls have tabs along one of the sides and wherein the tabs of the sidewalls and the end walls are inserted into the slots in the bottom plate to position the end walls and sidewalls on the bottom plate.

15. The container of claim 1 wherein the bottom plate has a front edge and an opposed back edge with an opposed right and left edge extending therebetween, wherein the first end wall is positioned adjacent the front edge and the second end wall is positioned adjacent the back edge with the first sidewall positioned adjacent the right edge and the second sidewall positioned adjacent the left edge and wherein the end walls and sidewalls form a rectangular inner chamber.

16. The container of claim 15 wherein the first dividers and second dividers intersect and form compartments in the inner chamber and wherein the compartments have a rectangular shape.

17. The container of claim 1 wherein guards are mounted on the edges of the bottom plate adjacent one side of the end walls to protect the end walls from damage.

18. The container of claim 1 wherein the end walls are provided with openings along one side adjacent the bottom plate to allow the container to be lifted using a forklift.

19. The container of claim 18 wherein the first divider has an opening adjacent the bottom plate which corresponds to the openings in the end walls.

20. The container of claim 18 wherein there are a plurality of second dividers and wherein the second dividers include outer second dividers which are positioned between one side of the end walls opposite the bottom plate and the openings in the end walls such that the outer second dividers do not extend into the openings.

21. The container of claim 20 wherein protector plates are mounted on a side of the outer second dividers adjacent the openings such as to prevent entry into compartments formed by the first and second dividers.

22. The container of claim 1 wherein the end walls, sidewalls and dividers have a flat, plate-like construction.

23. A container for use during heat treating to hold a part, which comprises:

(a) a bottom plate having opposed ends with opposed sides extending therebetween;

(b) a pair of end walls mounted on the opposed ends of the bottom plate and extending outward from the bottom plate in a direction perpendicular to the bottom plate;

(c) a pair of sidewalls mounted on the opposed sides of the bottom plate and extending outward from the bottom plate in a direction perpendicular to the bottom plate and similar to the direction of the pair of end walls;

(d) first dividers having opposed ends with a first side and a second side extending between the ends and having slots extending from the first side toward the second side and positioned such that one of the ends is adjacent one of the sidewalls and the other one of the ends is adjacent the other one of the sidewalls and extending in a direction similar to the direction of the pair of sidewalls; and (e) second dividers having opposed ends with a first side and a second side extending between the ends and having slots extending from the second side toward the first side and positioned such that one of the ends is adjacent one of the end walls and the other one of the ends is adjacent the other one of the sidewalls and extending in a direction similar to the direction of the pair of end walls and wherein the slots of the first dividers interlock with the slots of the second dividers such that the first and second dividers are interconnected.

24. The container of claim 23 wherein the pair of end walls and the pair of sidewalls are reconnected together to form a rectangular chamber and wherein the first dividers and second dividers intersect and form compartments in the chamber and wherein the compartments have a rectangular shape.

25. The container of claim 24 wherein a guide cradle is mounted in each of the compartments and wherein the guide cradle is configured to space the part above the bottom plate.

26. The container of claim 25 wherein the guide cradle has an L-shape with a first leg and a second leg and wherein side guides are mounted along sides of the first leg to guide the part onto the guide cradle.

27. The container of claim 23 wherein the first and second dividers have tabs along the first sides at an intersection point of the first and second dividers and wherein securing disks are mounted over the tabs to secure the first and second dividers together.

28. The container of claim 23 wherein the end walls, sidewalls and dividers have a flat, plate-like construction.

29. The container of claim 23 wherein the second dividers includes a pair of outer second dividers and one or more inner second dividers and wherein each of the outer second dividers is positioned adjacent one of the sidewalls and the inner second dividers are positioned such that the outer second dividers are spaced between the sidewalls and the inner second dividers.

30. The container of claim 23 wherein guards are mounted on the bottom plate adjacent the end walls to protect the end walls from damage.

31. The container of claim 23 wherein the end walls are provided with openings adjacent the bottom plate to allow the container to be lifted using a forklift.

32. The container of claim 31 wherein the first dividers have openings adjacent the second side which coincide with the openings in the end walls.

33. The container of claim 31 wherein the second dividers include outer second dividers which are positioned between one side of the end walls opposite the bottom plate and the openings in the end walls such that the outer second dividers do not extend into the openings.

34. The container of claim 33 wherein protector plates are mounted on the second side of the outer second dividers adjacent the openings such as to prevent entry into compartments formed by the first and second dividers.

35. A method for heat treating a part, which comprises:

(a) providing a heat treat container including a bottom plate having a plurality of edges; a first end wall mounted adjacent one of the edges of the bottom plate and extending outward from the bottom plate in a direction perpendicular to the bottom plate, the first end wall having a first end and a second end with opposed sides extending between the ends with at least one slot extending between the sides; a second end wall mounted adjacent one of the edges of the bottom plate opposite the first end wall and extending outward from the bottom plate perpendicular to the bottom plate in a direction similar to the direction of the first end wall, the second end wall having a first end and a second end with opposed sides extending between the ends with at least one slot extending between the sides; a first sidewall mounted adjacent one of the edges of the bottom plate and extending outward from the bottom plate perpendicular to the bottom plate in a direction similar to the direction of the first end wall, the first sidewall having a first end and a second end with opposed sides extending between the ends with at least one slot extending between the sides; a second sidewall mounted adjacent one of the edges of the bottom plate and extending outward from the bottom plate perpendicular to the bottom plate in a direction similar to the direction of the first end wall, the second sidewall having a first end and a second end with opposed sides extending between the ends with at least one slot extending between the sides; a first divider having opposed ends with a tab on each of the opposed ends and positioned such as to extend between the first and second sidewalls such that the tab at one end of the first divider extends into one of the slots of the first sidewall and the tab on the other end of the first divider extends into one of the slots of the second sidewall; and a second divider having opposed ends with a tab on each of the opposed ends and positioned such as to extend between the first and second end walls such that the tab at one end extends into one of the slots of the first end wall and the tab on the other end extends into one of the slots of the second end wall;

(b) positioning the part in the container;

(c) heating the container with the part; and (d) quenching the container with the part.

36. A method of claim 35 wherein the container has a plurality of compartments wherein one part is positioned in each compartment such that a plurality of parts are heat treated simultaneously.

* * * * *